United States Patent [19]

Manabe et al.

[11] 4,205,871

[45] Jun. 3, 1980

[54] ROPE TRACTION APPARATUS

[75] Inventors: Hikaru Manabe, Hiratsuka; Kiyoshi Shoda, Tokyo; Yutaka Sugiyama, Kawagoe, all of Japan

[73] Assignee: Nihon Biso Kabushiki Kaisha, Japan

[21] Appl. No.: 930,238

[22] Filed: Aug. 2, 1978

[30] Foreign Application Priority Data

Aug. 17, 1977 [JP] Japan ..... 52-97774
Dec. 5, 1977 [JP] Japan ..... 52-145197

[51] Int. Cl.[2] ..... B66C 1/34
[52] U.S. Cl. ..... 294/82 R
[58] Field of Search ..... 294/82 R, 74, 77, 67 E, 294/67 EA, 67 BA; 24/118, 127, 128 R, 138 R; 254/169; 214/1 P, 1 PA; 248/60, 74 B

[56] References Cited

U.S. PATENT DOCUMENTS 2,223,389 12/1940 Schaedler ..... 24/127

*Primary Examiner*—James B. Marbert

*Attorney, Agent, or Firm*—Robert E. Burns; Emmanuel J. Lobato; Bruce L. Adams

[57] ABSTRACT

A rope traction apparatus includes a sheave around which an intermediate length of traction rope extends. One run of the rope which is located on one side of the sheave provides a traction run while the run located on the other side thereof provides a free run. The sheave is firmly mounted on a drive shaft which is rotatably mounted on a frame assembly. The frame assembly is provided with an operating member which is rotatably mounted on a support shaft which extends parallel to the drive shaft. The operating member has its opposite ends located adjacent to the periphery of the sheave and each carry a roller having an axis which extends parallel to the drive shaft. One of the rollers is located to engage the traction run of the rope to cause an angular movement of the operating member in response to the tension therein. The other roller is located close to the sheave to hold the traction rope in a groove formed in the sheave as a result of the angular momentum applied to the operating member.

9 Claims, 9 Drawing Figures

ROPE TRACTION APPARATUS

FIELD OF THE INVENTION

The invention relates to a rope traction apparatus, and more particular to such apparatus which is provided with a drive sheave which is maintained in firm frictional engagement with a traction rope as a result of the tension therein.

A rope traction apparatus is used with a moving scaffold which is suspended by a wire rope or hemp rope fastened to an anchorage located on the roof of a building to depend therefrom along the exterior wall of the building for building construction or cleaning purposes. In such applications, one end of the rope is anchored to a hook unit fixedly mounted on the roof, and the moving scaffold can be raised or lowered by driving a rope traction apparatus which operatively engages an intermediate length of the rope. The traction apparatus is provided with a sheave around which the rope extends and which may be rotated by a driving source such as an electrical motor or a manual handle having a mechanical brake and a ratchet mechanism in order to move the scaffold up and down. The load of the scaffold is applied to the length of the rope which is located between its upper end and the sheave while the other end of the rope remains free from load normally, so that the rope must be wrapped around substantially the entire periphery of the sheave with a strong frictional force in order that the scaffold can be moved up and down as the sheave is rotated.

To provide means which assures a positive frictional engagement between the traction rope and the sheave, a rope hoist is disclosed in Japanese Patent Publication No. 2,500/1965, for example. In this apparatus, the sheave is provided with a chain-like retainer around substantially one-half the periphery thereof in order to engage the surface of the traction rope which extends around the sheave. One end of the retainer is secured to a frame while its other end is connected with one end of a folded lever which is rotatably mounted on the frame. The other end of the lever is connected with a hook, which is anchored to a ceiling, for example. The lever rotates in accordance with the load which is applied to the traction run of the rope to move the retainer along the surface of the traction rope, thus urging it into firm engagement with the groove of the sheave.

However, when such rope hoist is used to move a scaffold up and down, the hook must be located in a direction opposite from the traction run of the rope, and the frame of the hoist cannot be secured to the moving scaffold. Additionally, the arrangement requires an increased number of parts and is also complex in construction, resulting in an increased installation cost and making a repair operation difficult to be achieved.

SUMMARY OF THE INVENTION

It is an object of the invention to provide a rope traction apparatus which is simple in construction but which enables a traction rope to be positively held against the peripheral surface of sheave.

It is another object of the invention to provide a rope traction apparatus in which the free run of the rope is driven into the groove of a sheave in response to the tension in the traction run of the rope.

It is a further object of the invention to provide a rope traction apparatus which prevents the unevenness in the profile of the traction rope which is caused by twisted strands from interfering with the positive engagement of the free run of the rope against the sheave.

In accordance with the invention, there is provided a rope traction apparatus including a frame assembly, a drive shaft rotatably mounted on the frame assembly, and a sheave mounted on the drive shaft and having a groove formed in its peripheral surface, the sheave being adapted to receive a rope in the groove therein, one run of the rope extending to one side of the sheave being a traction run subject to a load and the other run located on the other side being a free run, the apparatus being characterized by the provision of an operating member which is rotatably mounted on a support shaft carried by the frame assembly in parallel relationship with the drive shaft and having at least two end portions which are located around the periphery of the sheave, first roller means including at least one roller which is mounted on one of the end portions of the operating member and disposed in operative engagement with the traction run of the rope to cause an angular movement of the operating member to move the other end portion toward the periphery of the sheave in response to the tension in the rope, and second roller means mounted on the other end portion of the operating member for forcedly urging the free run of the rope against the sheave in response to the angular movement of the operating member.

According to the invention, the free run of the rope which may move out of a frictional engagement with the sheave is urged against the groove in the sheave by a pressing or bias roller which responds to the tension in the traction rope. Consequently, the traction rope is engaged in the groove of the sheave over substantially the full periphery thereof, thereby providing a rope traction apparatus having an increased frictional force.

In accordance with the invention, a pair of rollers may be disposed at points which are spaced apart circumferentially of the sheave to engage the free run of the rope, and an oscillating member which supports these two rollers may be pivotally mounted on the operating member. This accommodates for a vertical oscillation of the rollers caused by the helical groove formed in the contour of the traction rope, allowing the rope to be maintained urged against the sheave under a uniform pressure.

DESCRIPTION OF PREFERRED EMBODIMENTS

Figure 1:
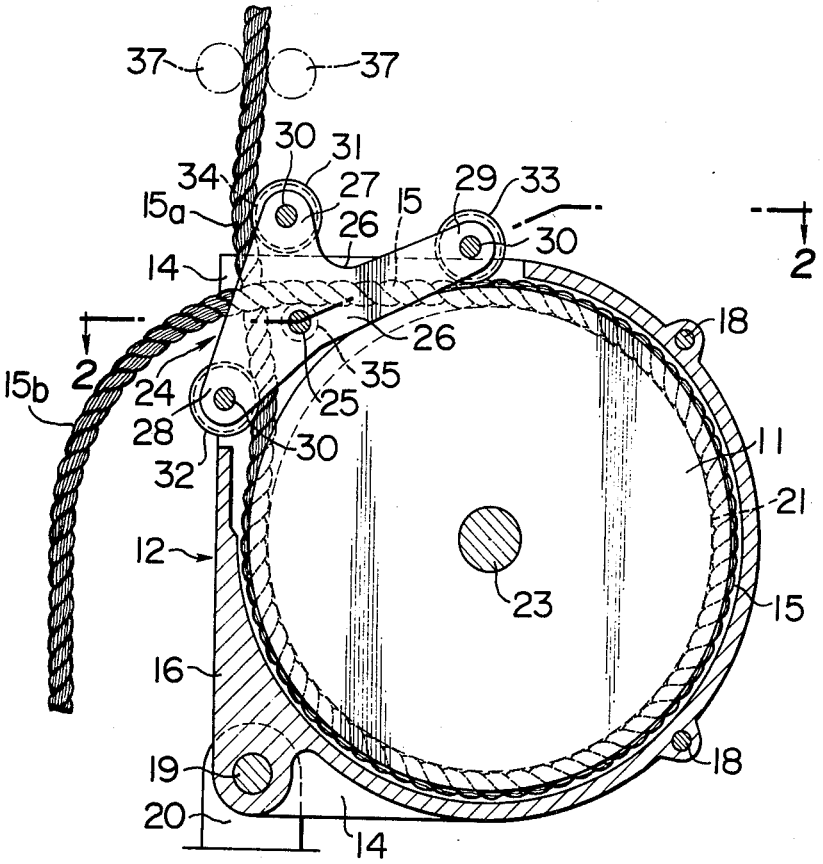
FIG. 1 is a side elevation, partly cut away, of a rope traction apparatus according to one embodiment of the invention.

Throughout the drawings, corresponding parts are designated by like reference characters.

Figure 2:
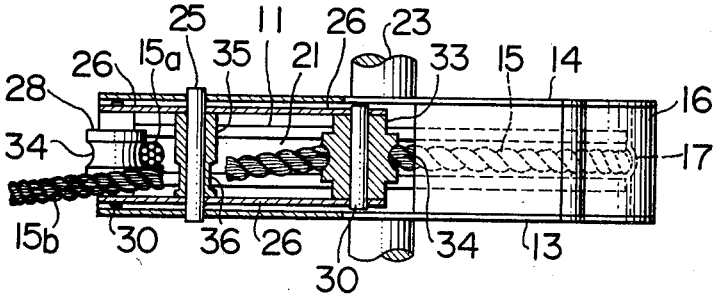
FIG. 2 is a cross section taken along the line 2—2 shown in FIG. 1.

Referring to FIGS. 1 and 2, there is shown sheave 11 which is supported by frame assembly 12. The assembly 12 comprises a pair of sideplates 13, 14 which are located on the opposite sides of sheave 11, and a circumferential wall 16 which extends around nearly three quarters of the periphery of sheave 11 to leave an opening which permits an access of traction rope 15 such as wire rope, hemp rope or cotton rope into the assembly. The wall 16 is spaced from the peripheral surface of sheave 11, and is internally formed with guide groove 17 to receive traction rope 15. Sideplates 13, 14 and circumferential wall 16 are integrally fastened together by bolts 18. Shaft 19 extending through sidewalls 13, 14 and wall 16 pivotally mounts the frame assembly 12 on bracket 20 extending from a moving scaffold, not shown.

Figure 3:
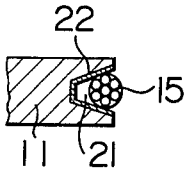
FIG. 3 is a fragmentary cross section of the sheave shown in FIG. 1.

As shown in FIG. 3, the peripheral surface of sheave 11 is formed with annular groove 21 for engagement with rope 15. The surface of groove 21 is formed with thin layer 22 of a hard material such as ceramic, tungsten carbide or the like as by metallizing, in order to increase the abrasion resistance. In the example shown, the groove 21 is trapezoidal in section, but may be V- or U-shaped as well. Sheave 11 is mounted on drive shaft 23 which is in turn rotatably supported by sideplates 13, 14. While not shown, drive shaft 13 is arranged to be driven by a driving source such as an electric motor or a manual handle through a mechanical brake and a ratchet mechanism respectively.

Traction rope 15 is inserted through the opening in wall 16 to extend along annular groove 21 substantially through one turn and is finally taken out of the opening. One end of rope 15 is connected with the free end of an elevation arm of a crane which is installed on the roof of a building, for example, a rope run **15*a* extending between the elevation arm and sheave 11 being subject to a load. The other end of rope 15 remains free, and hence a rope run 15*b* extending between sheave 11 and its free end is free from load. Thus, rope run 15*a* represents a traction run while rope run 15*b*** represents a free run.

Bias assembly generally shown at 24 is mounted in the opening of frame assembly 12. It comprises pivot 25 having its opposite ends mounted in sideplates 13, 14, and a pair of operating plates 26 which are rotatably mounted on pivot 25 and are spaced apart by a distance which is greater than the axial length of sheave 11. Each operating plate 26 includes first portion 27 extending from pivot 25 in a direction parallel to the traction run **15*a*, second portion 28 extending toward a region where traction run 15*a* tangentially engages sheave 11, and third portion 29 extending toward a region where the free run 15*b* tangentially engages sheave 11. At the end of these portions 27 to 29, the both operating plates 26 carry support shafts 30 which extend in a direction parallel to drive shaft 23 and which rotatably mount introduction roller 31, operating roller 32 and bias roller 33. The peripheral surface of each roller 31, 32, 33 is centrally formed with circumferentially extending guide groove 34 for receiving traction rope 15 therein. Another guide roller 35 is rotatably mounted on pivot 25 and is also circumferentially formed with guide groove 36 and guides the free run 15*b* so as to avoid its interference with traction run 15*a***.

As shown in FIG. 1, traction rope 15 is passed along the left-hand side of introduction roller 31 and then along the right-hand side of operating roller 32, and then extends around sheave 11. After extending around sheave 11, rope 15 passes under bias roller 33 to be taken out of frame assembly 12. When traction run **15*a* is tensioned, introduction roller 31 and operating roller 32 are urged by the rope to cause an angular movement of operating plates 26 in the clockwise direction. As a result of this movement, bias roller 33 urges free run 15*b* against sheave 11, whereby free run 15*b* is tightly pressed into annular groove 21. This pressing action of bias roller 33 in combination with the tensioning of traction run 15*a* uniformly tightens traction rope 15 around sheave 11 over substantially the entire periphery thereof, thus increasing the friction between rope 15 and groove 21. This prevents any slippage between rope 15 and sheave 11, so that the moving scaffold can be stopped at any position along the length of traction rope. Also, by rotating sheave 11**, the scaffold can be moved up and down in a reliable manner.

In order to achieve the desired action mentioned above, it is necessary to satisfy a certain relationship between sheave 11 and bias assembly 24. Specifically, operating roller 32 is located between introduction roller 31 and sheave 11 in a manner such that a common tangential drawn to the effective surfaces of sheave 11 and introduction roller 31 is spaced from a tangential, which is drawn to the effective surface of operating roller 32 in a direction parallel to the common tangential, by a distance which is less than the thickness of traction rope 15. In a modification, it is possible to choose an arrangement in which the tangential to operating roller 32 coincides with the common tangential or is located inwardly thereof or nearer drive shaft 23. Pivot 25 of operating plates 26 is located intermediate imaginary planes extending through introduction roller 31 and operating roller 32, respectively, and which are perpendicular to a vertical plane including introduction roller 31 and operating roller 32. On the other hand, in order to maintain the apparatus in the position or orientation shown in FIG. 1 in use, the mounting shaft 19 must be located between a vertical plane including introduction roller 31 and another vertical plane including operating roller 32. This mounting shaft 19 serves maintaining frame assembly 12 in its orientation shown in FIG. 1 relative to traction rope 15 if there is a change in the direction in which the anchored end of rope 15 extends. Where frame assembly 12 is firmly secured, a pair of external guide rollers 37 may be provided as indicated by phantom lines in FIG. 1. These rollers may be provided on the moving scaffold or on an extension of frame assembly which is located adjacent to the traction run **15*a* in order to maintain a constant angle of encounter of rope 15 with respect to introduction roller 31**.

In the apparatus shown in FIG. 1, operating plates 26 are angularly driven from both introduction roller 31 and operating roller 32. However, the apparatus may be modified in a manner such that operating plates 26 are subject to an angular drive from a selected one of rollers 31, 32. In such a modification, the other roller may be omitted. It will be appreciated that the selected roller be located such that a tangential thereto be spaced from a tangential to the effective surface of the sheave and passing through the anchored end of rope by a distance which is less than the thickness of traction rope, including a negative distance.

Figure 4:
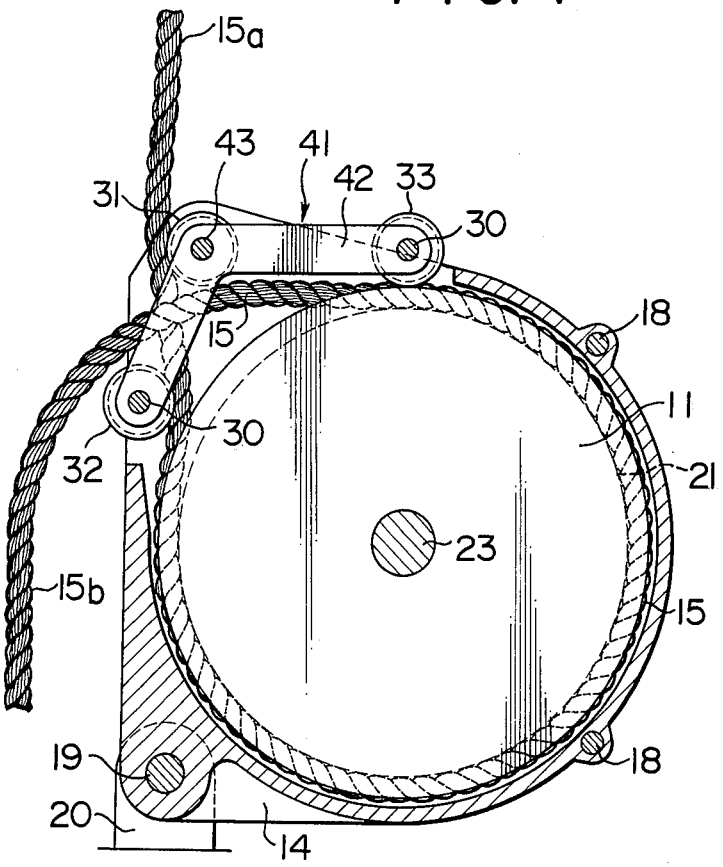
FIG. 4 is a side elevation, partly cut away, of another embodiment of the invention.

FIG. 4 illustrates another embodiment of the invention which is similar to the previous embodiment except for the construction of a bias assembly 41. Therefore, corresponding parts to those of the first embodiment will not be described. Bias assembly 41 comprises a pair of operating plates 42 in the form of substantially L-shaped bell cranks, with introduction roller 31 being mounted on the bend of plates 42. Operating roller 32 and bias roller 33 are mounted on the opposite ends thereof. Introduction roller 31 is rotatably mounted on pivot 43 carried by operating plates 42. In this embodiment, the relative position of these rollers remains the same as in the first embodiment, but introduction roller 31 remains stationary when the rope tension is applied, while operating roller 32 operates to angularly drive operating plates 42 clockwise about pivot 43. The clockwise rotation of operating plates 42 urges bias roller 33 in a direction toward drive shaft 23. This, combined with the tensioning of traction rope 15, uniformly tightens rope 15 around sheave 11 over substantially the entire periphery thereof.

Figure 5:
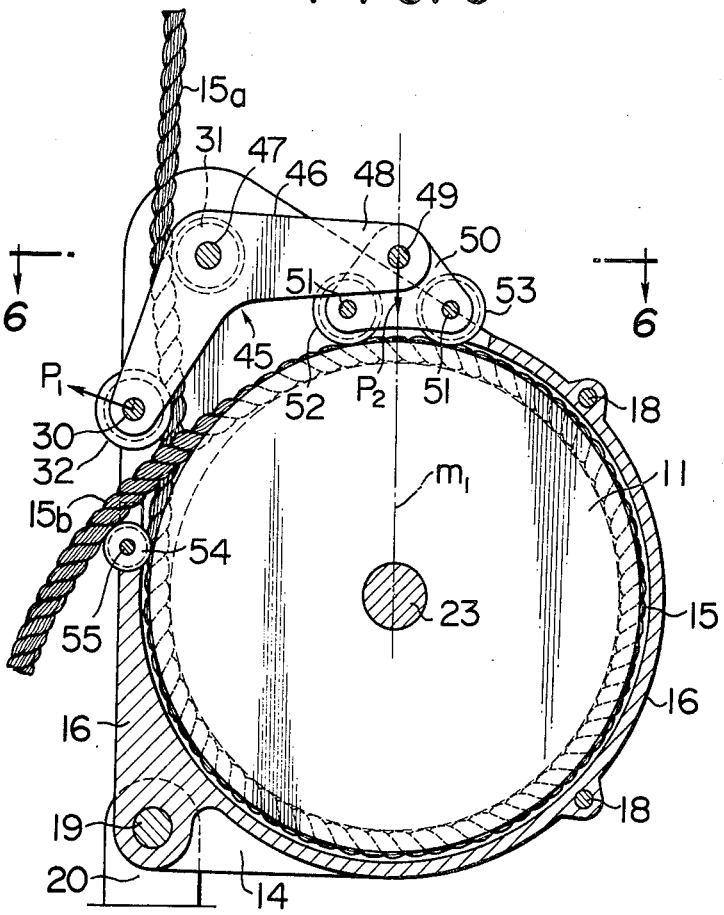
FIG. 5 is a side elevation, partly cut away, of a further embodiment of the invention.
Figure 6:
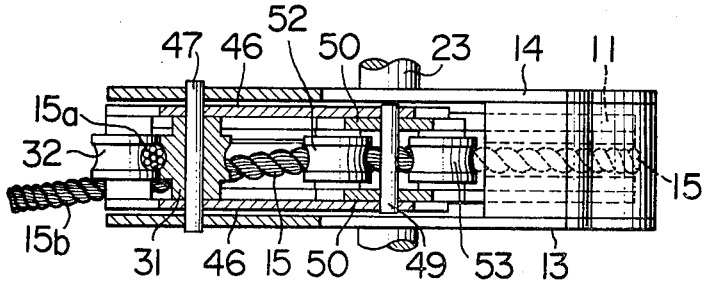
FIG. 6 is a section taken along the line 6—6 shown in FIG. 5.

FIGS. 5 and 6 show a further embodiment of the invention including a mechanism which absorbs or suppresses a rattling of operating plates which may be caused by an irregular contour of rope 15 which is formed as a result of twisted strands. Generally, a traction rope comprises a plurality of strands which are twisted together, so that helical depressions are formed in the outer profile of rope. Consequently, if a single bias roller is used to urge traction rope against sheave, the roller may be oscillated vertically as rope runs, causing an intermittent change in the pressure with which rope is urged against sheave.

In the present embodiment, bias assembly 45 comprises a pair of angularly movable plates 46 in the form of substantially L-shaped bell cranks, with introduction roller 31 being mounted on pivot 47 which rotatably mounts operating plates 46. Support shaft 49 extends across those ends 48 of operating plates 46 which are located directly above sheave 11. It is to be noted that support shaft 49 is located on a vertical line m extending through the axis of drive shaft 23. A pair of triangular oscillating plates 50 having their major surface parallel to that of sheave 11 have their apices rockably mounted on support shaft 49. Support shafts 51 extend across aligned corresponding lower ends of oscillating plates 50 and pivotally mount bias rollers 52, 53. The spacing between bias rollers 52, 53 is chosen to be different from the helical pitch of undulations in the outer profile of traction rope 15. It is to be noted that in the present embodiment, operating plates 46 are located at a higher elevation than those shown in the first and second embodiments, and free run **15*b* of rope 15 is taken out of frame assembly 12 at a position below operating roller 32. In this manner, it is assured that rope 15 extends around the entire periphery of sheave 11. Frame assembly 12 carries guide pully 54 which is rotatably mounted on support shaft 55 having its opposite ends supported by sideplates 13, 14. Pully 54 receives the free run 15*b* as it is taken out of frame assembly 12. The relative position between introduction roller 31 and operating roller 32** remains unchanged from that mentioned in connection with the first embodiment, and in other respects, the arrangement is similar as described above in connection with the first and second embodiments, and hence will not be described.

When the traction run **15*a* is tensioned, operating roller 32 is urged in a direction indicated by arrow $P_1$, whereby operating plates 46 are driven to rotate clockwise about pivot 47. In response to such angular movement, support shaft 49 for operating plates 46 is driven in a direction indicated by arrow $P_2$, or toward the axis of sheave 11 on the vertical line $m_1$, thus causing the pair of bias rollers 52, 53 to urge the free run 15*b* of rope 15 against circumferential groove 21 of sheave 11. Since the spacing between bias rollers 52, 53 is different from the pitch of undulations in the rope 15, it will be understood that when one bias roller is engaged with the depression of the undulation, the other roller engages a different region of rope 15. Consequently, the combination of the pair of oscillating plates 50 and bias rollers 52, 53** prevents a vertical oscillations of these rollers as rope runs, assuring that the traction rope be maintained urged against the sheave under a uniform pressure.

In the three embodiments described above, the principal vector of force with which bias roller urges rope against sheave is directed radially of the sheave, but it will be seen that any slippage of traction rope will occur in the clockwise direction relative to the sheave when the latter remains stationary. As a consequence, it will be seen that it is desirable to have the principal vector of force exerted by bias roller acting in the counter-clockwise direction.

Figure 7:
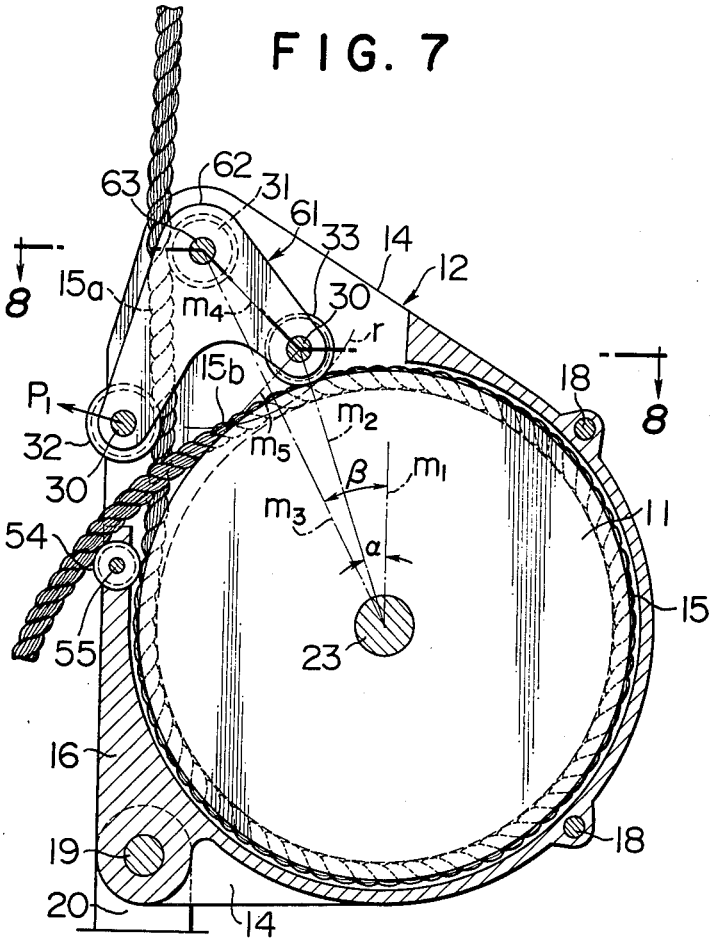
FIG. 7 is a side elevation, partly cut away, of a fourth embodiment of the invention.
Figure 8:
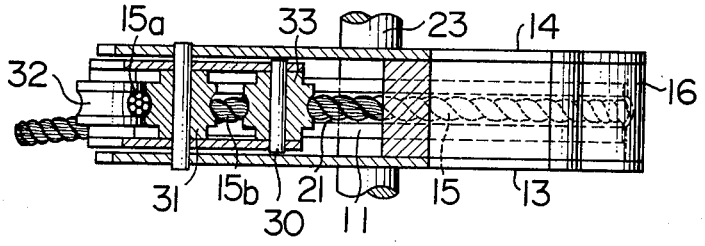
FIG. 8 is a section taken along the line 8—8 shown in FIG. 7.

Referring to FIGS. 7 and 8 which show a fourth embodiment of the invention, bias assembly 61 includes a pair of operating plates 62 in the form of inverted V-shaped bell cranks. Introduction roller 31 is rotatably mounted on pivot 63 of operating plates 62 which is located at the apex of operating plates 62. Operating roller 32 and bias roller 33 are mounted on the opposite ends of the bell cranks. The positional relationship between introduction roller 31 and operating roller 32 remains the same as in the first embodiment. Bias roller 33 which urges traction rope 15 is mounted on operating plates 62 such that the angle $\alpha$ formed between vertical line $m_1$ extending through the axis of sheave 11 and line $m_2$ joining the center of bias roller 33 when sheave 11 is loaded and the axis of sheave 11 is less than the angle $\beta$ formed between the vertical line $m_1$ and line $m_3$ joining the axis of pivot 63 and the axis of sheave 11. Stated differently, the arrangement is such that the angle formed between line $m_2$ joining the center of bias roller 33 and the axis of sheave 11 and line $m_5$ which is perpendicular to line $m_4$ joining the axis of pivot 63 and the center of bias roller 33 be less than 90° and greater than 0°. When the angle formed between lines $m_2$ and $m_5$ is equal to 90° or when the angles $\alpha$ and $\beta$ are equal to each other, the point of contact between bias roller 33 and sheave 11 will be located on line $m_3$, allowing bias roller 33 to move to the left of line $m_3$. Then it is ineffective to urge traction rope 15 against sheave. When the angle exceeds 90°, bias roller 33 is removed from the peripheral surface of sheave 11. On the other hand, when the angle approaches 0°, force exerted by bias roller 33 will be directed toward the axis of sheave 11. It will thus be seen that the angles $\alpha$ and $\beta$ may be chosen to satisfy the inequality $\alpha < \beta$ depending on the magnitude of load applied to sheave 11.

In operation, when the traction run **15*a* is tensioned, operating roller 32 is urged in the direction of arrow $P_1$ to cause operating plates 61 to rotate clockwise. In response thereto, bias roller 33 urges free run 15*b* against annular groove 21 of sheave 11, with its point of engagement with sheave following an arcuate locus r which is centered about pivot 63. Thus bias roller 33 can urge traction rope 15 against sheave 11 in a direction in which the rope extends out of sheave 11. In this manner, rope 15 is tightly held against annular groove 21 of sheave 11 over substantially the entire periphery thereof, thus increasing the friction between rope 15 and groove 21**.

Figure 9:
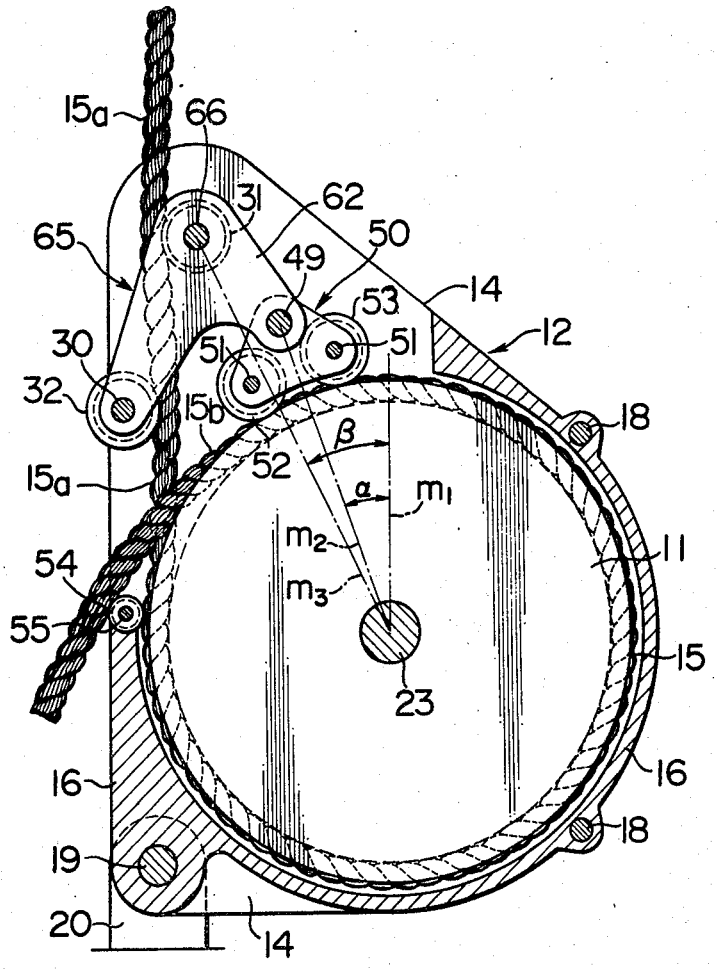
FIG. 9 is a side elevation, partly cut away, of a fifth embodiment of the invention.

FIG. 9 shows a fifth embodiment of the invention which includes bias assembly 65 having a mechanism which prevents a rattling thereof as may be caused by varying profile of twisted strands of traction rope 15, by the provision of a pair of bias rollers 52, 53 located in engagement with the free run 15*b* of rope 15. In this respect, the arrangement is similar to that described in connection with the third embodiment, and therefore will not be described. As before, rollers 52, 53 are supported by oscillating plates 50 which are pivotally mounted on support shaft 49 having the axis which is located in the same manner as the center of bias roller 33 of the fourth embodiment. Therefore, in this embodiment, rollers 52, 53 strongly urges the free run 15*b* against the annular groove 21 while preventing a vertical oscillation of the rollers as rope 15 runs, assuring that the rope be maintained tightly held against the sheave with a uniform pressure.

While several preferred embodiments of the invention have been specifically shown and described, it should be understood that they are exemplary only, and not limitative of the invention. In the above description, the apparatus of the invention has been described as used in moving a scaffold up and down which is suspended by a rope having its one end anchored to the roof of a building. However, the apparatus is equally applicable to the lifting or towing of an article.

What is claimed is:

1. In a wire traction apparatus including a frame assembly, a drive shaft rotatably mounted on the frame assembly to rotate about its fixed axis, and a sheave mounted on the drive shaft and formed with an annular groove in its peripheral surface, the sheave receiving a rope which is fitted into the groove, one run of the rope extending to one side of the sheave being a traction run which is subject to a load and the other run extending to the other side being a free run; the improvement which comprises an operating member rotatably disposed on a support shaft which is fixedly mounted on the frame assembly in parallel relationship with the drive shaft and having at least two end portions which are located around the periphery of the sheave, first roller means including at least one roller mounted on one of the end portions of the operating member for operative engagement with the traction run of the rope to cause an angular movement of the operating member in a direction to urge the other end portion thereof toward the periphery of the sheave in response to a tension in the rope, and second roller means including at least one roller mounted on the other end portion of the operating member for forcedly urging the free run of the rope which extends around the sheave against the sheave as the operating member is angularly driven.

2. A rope traction apparatus according to claim 1 in which the first roller means is disposed on a side of a first plane including the traction run of the rope which is nearer a second plane parallel to the first plane and including the drive shaft.

3. A rope traction apparatus according to claim 1 in which the first roller means is disposed on a side of a first plane including the traction run of the rope which is remote from a second plane including the drive shaft.

4. A rope traction apparatus according to claim 1 in which the first roller means includes an operating roller and an introduction roller which are located along the traction run of the rope, the operating roller being mounted on one end portion of the operating member at a location nearer the sheave than the introduction roller, the rollers being positioned such that the rope is curved inwardly of a common tangential to the introduction roller and the sheave, both the introduction and the operating roller acting to cause an angular movement of the operating member in a same direction.

5. A rope traction apparatus according to claim 1 in which the first roller means include an introduction roller and an operating roller disposed along the traction run of the rope, the introduction roller being mounted on the support shaft for the operating member, the operating roller being mounted on one end portion of the operating member and disposed nearer the sheave than the introduction roller, the rollers being positioned such that the rope is curved inwardly of a common tangential to the introduction roller and the sheave, the operating roller urging the operating member to cause an angular movement thereof about the support shaft.

6. A rope traction apparatus according to claim 1 in which the second roller means comprises a single bias roller mounted on a shaft which is disposed on the other end portion of the operating member, the bias roller urging the rope against the peripheral surface of the sheave.

7. A rope traction apparatus according to claim 6 in which the angle formed between a line joining the axis of a bias roller and the axis of the sheave and a vertical line passing through the axis of the sheave which represents one side of a right-angled triangle having a long side formed by a line joining the axis of rotation of the operating member and the axis of the sheave is less than an angle which is formed between the vertical line and a line joining the axis of rotation of the operating member and the axis of the sheave.

8. A rope traction apparatus according to claim 1 in which second roller means comprises an oscillating member pivotally mounted on the other end portion of the operating member, and a pair of bias rollers rotatably carried by the oscillating member and spaced apart from each other circumferentially of the sheave.

9. A rope traction apparatus according to claim 8 in which the angle formed between a line joining the axis of rotation of the oscillating member and the axis of the sheave and a vertical line passing through the axis of the sheave which represents one side of a right-angled triangle having a long side formed by a line joining the axis of rotation of the operating member and the axis of the sheave is less than the angle formed between the vertical line and a line joining the axis of rotation of the operating member and the axis of the sheave.

* * * * *